United States Patent [19]

Esposito et al.

[11] 4,218,979

[45] Aug. 26, 1980

[54] PIZZA STAND

[75] Inventors: Joseph P. Esposito, 7039 E. 71st Pl., Tulsa, Okla. 74133; Mesta M. Alexander, Tulsa, Okla.

[73] Assignee: Joseph P. Esposito, Tulsa, Okla.

[21] Appl. No.: 28,082

[22] Filed: Apr. 9, 1979

[51] Int. Cl.[3] ..... A47B 9/04

[52] U.S. Cl. ..... 108/106; 108/111; 108/141; 403/326

[58] Field of Search ..... 108/107, 106, 105, 103, 108/141, 111; 403/378, 155, 326; 211/144, 129

[56] References Cited

U.S. PATENT DOCUMENTS

| | | | |
|---|---|---|---|
| 844,754 | 2/1907 | Sardou et al. | 108/105 |
| 1,908,797 | 5/1933 | Svalland | 211/144 X |
| 2,766,473 | 10/1956 | Thackara | 403/326 X |
| 2,865,662 | 12/1958 | Nurmse | 403/378 X |
| 2,926,033 | 2/1960 | Zarrillo | 403/326 |
| 3,270,124 | 8/1966 | Rawls et al. | 403/155 X |
| 3,491,186 | 10/1969 | Luebbert et al. | 403/326 |

*Primary Examiner*—Francis K. Zugel
*Attorney, Agent, or Firm*—William S. Dorman

[57] ABSTRACT

A stand for supporting a plurality of objects at a plurality of different vertical levels comprising a vertical rod having a plurality of spaced circumferential grooves, a plurality of cylindrical collars each having a central bore therethrough of substantially the same size as the cross-section of the rod, each collar having a pair of opposite radial slots extending from the outside of the collar, a horizontal plate connected to each collar and extending radially outwardly from the collar for supporting objects thereon, and a plurality of clips for connecting the collars to the rod, wherein each clip is made of a continuous piece of wire bent intermediate its ends to form a substantially semi-circular loop with arms to engage the collar and the grooves.

1 Claim, 5 Drawing Figures

PIZZA STAND

BACKGROUND OF THE INVENTION

1. Field of the Invention

The present invention relates to a stand for supporting pizza pies at different verticaly spaced horizontal levels along a vertical rod and, more particularly, to a pizza stand where the supporting means are discs which can be removably attached at these vertically spaced levels along the rod.

2. Description of the Prior Art

The prior art discloses stands or devices for supporting objects at vertically spaced horizontal levels such as shown in Grennan Patent No. 1,703,340; however, the prior art does not disclose or suggest a spring type clip means whereby a plurality of discs may be removably mounted on a vertical rod at spaced horizontal levels for holding objects, such as pizzas, thereon.

SUMMARY OF THE INVENTION

The present invention involves a stand for supporting a plurality of objects, such as pizzas, at a plurality of vertically spaced levels. The stand includes a vertical rod which is rounded at its upper end and which connects with a cylindrical housing adjacent its lower end. A plurality of legs extend nearly horizontally outwardly but somewhat downwardly inclined from the cylindrical housing for supporting the rod in a vertical position. A plurality of discs are adapted to be supported along the rod at vertically spaced intervals. The lowermost disc is preferably disposed between the lower end of the rod and the cylindrical housing. The remaining discs are each provided with a central opening of the same size and shape as the cross-section of the rod. Each disc is also provided with a collar attached to the disc below the central hole thereof. Each collar is provided with a circular bore equal in size and disposed in alignment with the hole in each disc. The rod is further provided with a plurality of circumferential grooves of the same vertical width. Each collar is provided with a pair of opposite radial slots whose width is substantially equal to the width of the grooves on the rod. A plurality of clips are provided for connecting the collars to the rod. Each clip is made of a continuous piece of stainless steel spring wire which is bent intermediate its ends to form a loop which connects with a first pair of arms extending divergently away from the loop and which, when a given collar is disposed on the rod with its slots in alignment with a given circumferential groove, this first pair of arms is adapted to be received in the slots on the given collar and simultaneously in the given circumferential groove. The clip is further provided with a second pair of arms which connect with the first pair of arms at a location on the opposite side of the collar from the loop of the clip and which extends convergently away from the loop so as to form with the first pair of arms and with the loop a substantially horizontal plane. The second pair of arms of the clip connect with a third pair of arms which are disposed in parallel relation with each other and at right angles to the horizontal plane described above. The third pair of arms connect with a fourth pair of arms which are attached to the third pair of arms at right angles thereto and which extend in substantially parallel relation with the second pair of arms. Thus, the fourth pair of arms extend divergently away from each other towards the loop of the clip but spaced from the horizontal plane described above. This fourth pair of arms also contacts the outer periphery of the collar. Thus, when thumb pressure is applied to the third pair of arms in a direction towards the collar, the relative wedging action which occurs between the collar and the fourth pair of arms is such as to cause the clip to spread open whereby the first pair of arms are opened up and moved in a rearward direction (the direction of the force) so as to bring the first pair of arms out of the area of the circumferential groove, although the first pair of arms will still be received in the slots on the collar. At this time, the disc and its associated collar can be moved upwardly or downwardly with respect to the rod; alternatively, the given disc and associated collar can be removed completely from the rod by maintaining thumb pressure on the associated clip.

DETAILED DESCRIPTION OF THE PREFERRED EMBODIMENTS

Figure 1:
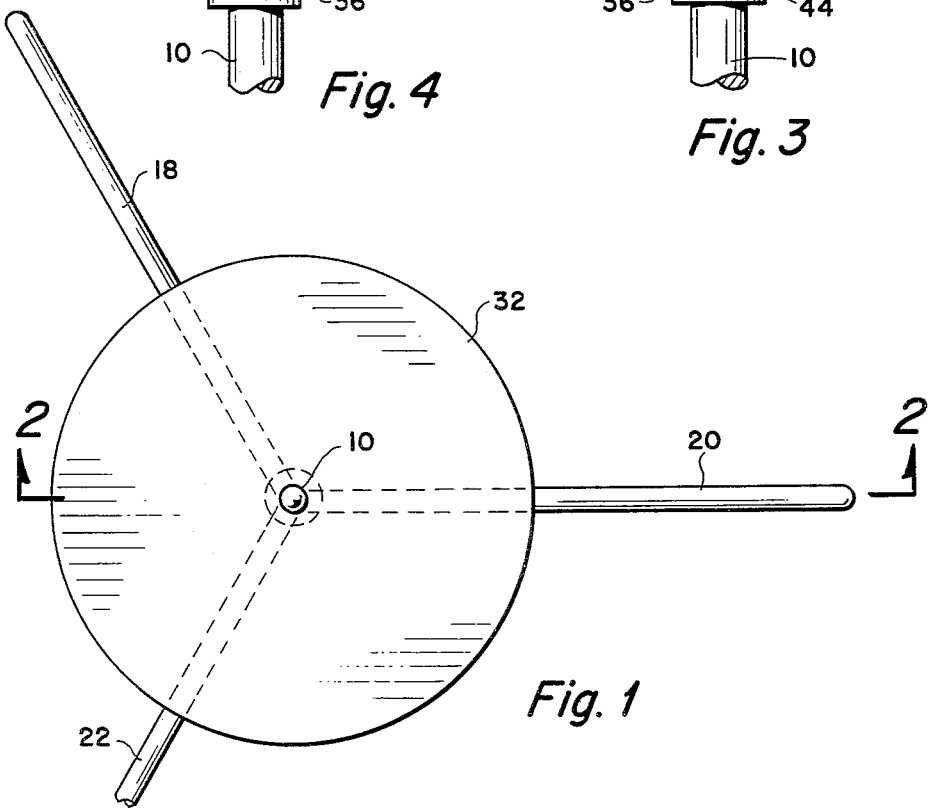
FIG. 1 is a plan view of the pizza holder of the present invention showing a portion of one of the supporting legs broken away.
Figure 2:
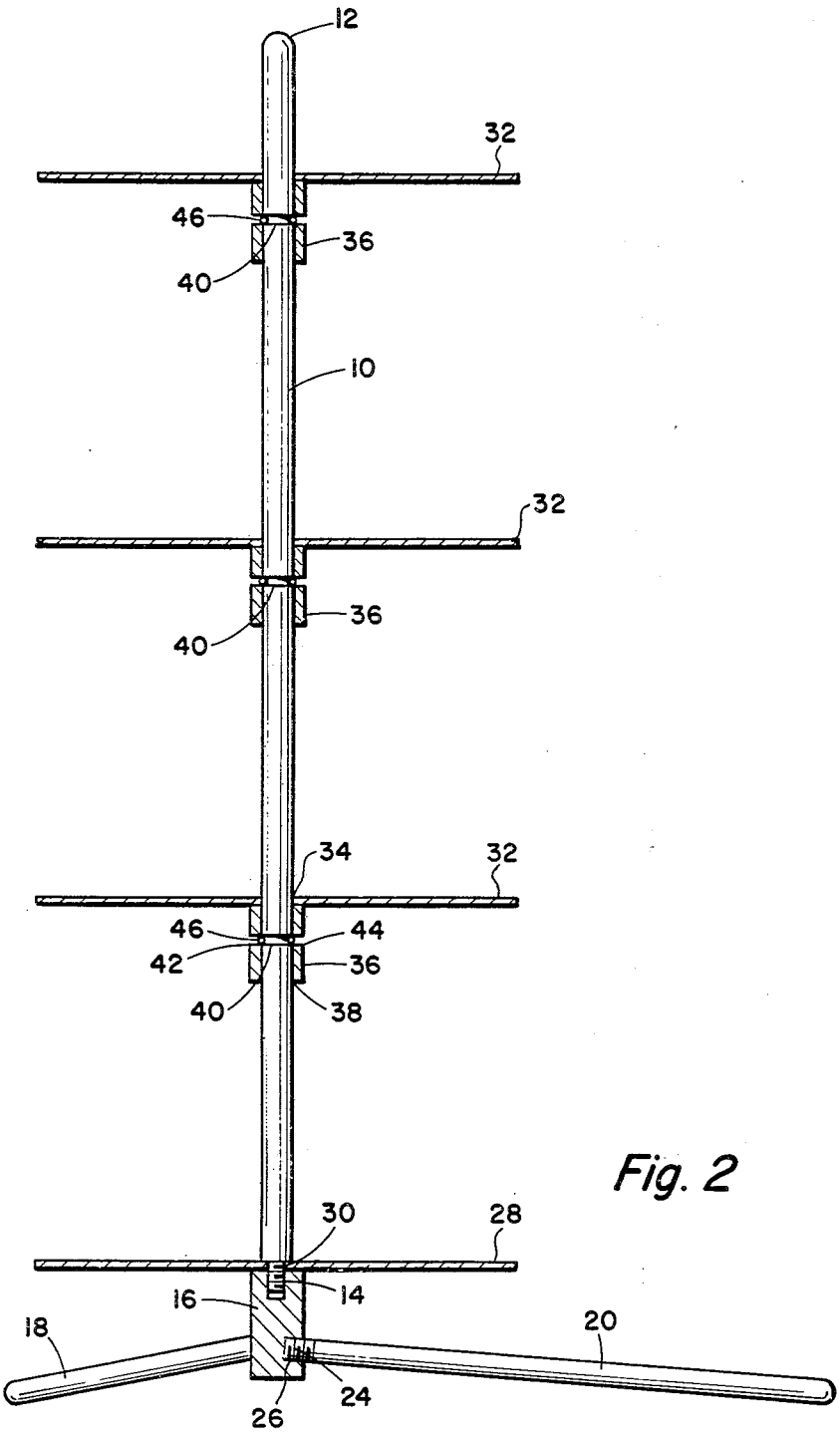
FIG. 2 is a vertical sectional view taken along section line 2—2 of FIG. 1.

Referring to the drawings in detail, FIGS. 1 and 2 show a substantially vertical rod 10 having an upper rounded end 12 and a lower threaded end 14 of reduced size. The lower threaded end 14 is adapted to be received in a threaded hole in a short cylindrical housing 16. Three legs 18, 20 and 22 extend radially outwardly from the cylindrical housing 16. The inner end of each leg, for example, the end 24 of the leg 20 is threaded and is adapted to be received in a threaded hole 26 in the cylindrical housing 16. The legs 18, 20 and 22 are preferably slightly downwardly inclined as shown in FIG. 2 so that, when the outer ends of these legs rest on the top of a table, for example, the lower end of the cylindrical housing 16 will be slightly spaced above the surface of the table.

A flat horizontal plate 28 in a form of a disc is received between the lower end of the rod 10 and the cylindrical housing 16. This disc 28 has a central hole 30 through which the lower threaded end 14 of the rod 10 is adapted to pass. This disc 28 constitutes the lowermost level upon which objects, such as pizzas, may be supported.

A plurality of discs 32 are adapted to be removably secured to the rod 10. As shown in FIG. 2, there are three such discs 32; however, it could be understood that a greater or lesser number of discs 32 could be employed. Whereas, the lowermost disc 28 is shown in a non-slidable or non-removable relationship, it should be understood that the lowermost disc 28 could be eliminated and replaced with a disc 32 and its method of attachment (as will be explained hereinafter) so that all discs mounted on the rod could be removable.

Each disc 32 is provided with a central opening or hole 34 of substantially the same size and shape as the cross-section of the rod 10 so that each disc can be received on the rod 10 and can be slid upwardly or downwardly with respect to the rod. A cylindrical collar 36 is attached to each disc 32 below the opening 34. Each collar 36 has a central bore 38 therethrough which is of the same size and in alignment with the hole 34 in the disc 32.

The rod 10 is provided with a plurality of circumferential grooves 40 which extend all the way around the rod and which are of substantially equal vertical width. Each collar 36 is provided with a pair of opposite radially directed slots 42 and 44 which extend from the outside of each collar and into the bore 38 thereof. As best shown in FIG. 2, when the discs 32 are properly positioned along the rod 10 the radial slots 42 and 44 are in alignment with the circumferential groove 40.

A plurality of clips 46 are employed to secure each collar 36 in position on the rod 10 when the slots 42 and 44 are in alignment with a circumferential groove 40.

Figure 5:
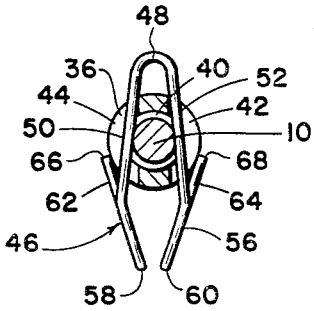
FIG. 5 is a sectional view taken along section line 5—5 of FIG. 3.
Figure 4:
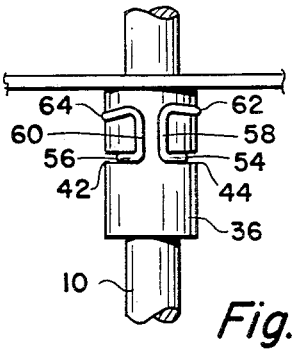
FIG. 4 is a left-hand side view taken from FIG. 3.
Figure 3:
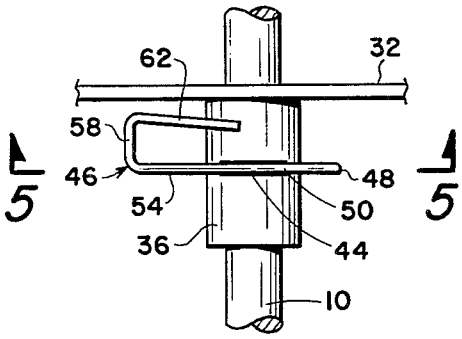
FIG. 3 is a fragmentary front elevation showing only a portion of the vertical rod and a portion of the horizontal disc but showing the relationship between the clip, the collar and the rod.

As best shown in FIGS. 3, 4 and 5, the clip 46, which is preferably made of a single piece of stainless steel spring wire, is bent intermediate its ends to form a substantially semi-circular loop 48. The ends of the loop 48 merge with a pair of arms 50 and 52 which extend divergently outwardly with respect to each other in a direction away from the loop, as best shown in FIG. 5. These arms 50 and 52 are adapted to be received in the slots 42 and 44 of the collar 36 and also simultaneously in the annular or circumferential groove 40 in the rod when the collar 36 is positioned such that its slots are in alignment with the circumferential groove. When the arms 50 and 52 are received in the slots and in the groove on the rod, the associated collar is locked in position so that it will neither slide upwardly nor downwardly along the rod 10. The arms 50 and 52 extend in their divergent direction to a location spaced beyond the periphery of the collar 36 as best shown in FIG. 5 at which location a second pair of arms 54 and 56 connect with the ends of the first pair of arms. The second pair of arms 54 and 56 extend convergently towards each other in a direction away from the loop 48. At this juncture it should be noted that the loop 48, the arms 50 and 52, and the second pair of arms 54 and 56 form a substantially horizontal plane. The outer ends of the arms 54 and 56, in turn, connect with the lower ends of a pair of vertical arms 58 and 60 (as best shown in FIG. 4) which extend at right angles to the horizontal plane defined by the loop and the first two pairs of arms. The upper ends of the third pair of arms 58 and 60 connect with a fourth pair of arms 62 and 64 which extend divergently away from each other in a direction towards the loop 48. As will appear from a consideration of FIG. 5, the fourth pair of arms 62 and 64 are parallel with the second pair of arms 54 and 56. The outer free ends 66 and 68 of the arms 62 and 64, respectively, constitute the ends of the piece of spring wire which is bent to form the clip itself. Incidentally, it should be understood that the thickness of the steel wire, which forms the clip 46, is substantially equal to the vertical width of the slots 42 and 44 as well as the vertical width of the circumferential groove 40 on the rod 10.

As best shown in FIGS. 3 and 5, the ends of the fourth pair of arms 62 and 64 engage the outer periphery of the collar 36. It will also appear that the third pair of arms 58 and 60 (see also FIG. 4) are relatively closely adjacent each other. Therefore, if one were to push on the arms 58 and 60 (for example, with simple thumb pressure) towards the collar 36, the relative wedging action, which exists between the collar 36 and the arms 62 and 64 will cause the clip to spread open whereby the first pair of arms 50 and 52 are spread apart relatively to a position where they are no longer received in the peripheral groove 40, even though these arms 50 and 52 will still be in the radial slots 42 and 44; at this time, it is possible to move the collar 36 upwardly or downwardly with respect to the groove 40 against which this collar was previously locked. In fact, by maintaining thumb pressure on the arms 58 and 60 the collar 36 and its associated disc can be moved entirely from the rod 10.

As indicated previously, the lowermost disc 32 is preferably relatively permanently associated with the rod 10 as shown in FIG. 2, although this relatively fixed disc 28 could be replaced by a movable disc 32 by adding a circumferential groove 40 (not shown) adjacent the bottom of the rod 10 and including and additional disc 32 and its associated collar 36, as described above. At any event, it will be assumed that there are no discs 32 on the rod 10 and that the lowermost disc 28 alone is disposed on the rod 10. At this point in time a pizza can be disposed over the rod 10 and lowered onto the lowermost disc 28. For this purpose, the circular pizza pans (not shown) would be provided with a central hole (not shown) of the same size as the shaft 10, and since the pizza itself will have been cut into pie-shaped sections, there will be no problem in lowering the pan and pizza onto the lowermost disc 26. Now, a disc 32 and its associated collar are disposed over the end of the rod 10 and, by manipulating a proper thumb pressure on the associated clip 46, this disc 32 is lowered into the position immediately above the lowermost disc 28 and, at this time, an additional pizza in its pan can be lowered into the position onto this disc 32. This process is repeated by adding one disc at a time, disposing a pizza and pizza pan over the disc and then adding the next disc until the rod 10 is provided with the maximum number of discs it is capable of holding.

Whereas, the present invention has been described in particular relationship to the drawings attached hereto, it should be understood that other and further modifications, apart from those shown or suggested herein, may be made within the spirit and scope of this invention.

What is claimed is:

1. A stand for supporting a plurality of objects at a plurality of different vertical levels comprising a vertical rod, means for supporting said rod in a vertical disposition, said rod having a plurality of spaced circumferential grooves therein of substantially equal vertical width, a plurality of cylindrical collars each having a central bore therethrough of substantially the same size as the cross-section of said rod, each collar having a pair of opposite radial slots therein extending from the outside of said collar to the bore thereof and being of substantially the same vertical width as one said grooves, a horizontal plate connected to each collar and extending radially outwardly therefrom for supporting objects thereon, a plurality of clips for connecting said collars to said rod, each clip being made of a continuous piece of spring wire having a thickness substantially equal to the vertical width of one of the grooves of said rod and being bent intermediate its end to form a semicircular loop with a first pair of spaced arms extending outwardly from opposite ends of said loop and defining with said loop a substantially horizontal plane, said first pair of arms being adapted to be received in a locking position in the opposite slots in a first one of said collars and also in a first one of said circuferential grooves on said vertical rod when said opposite slots of said first collar are placed in alignment with said first groove so as to lock said first collar in position in alignment with said first groove, said loop of said clip extending outwardly away from said first collar when said clip is positioned in said locking position, said first pair of arms extending divergently outwardly beyond said first collar on a side thereof opposite from said loop to a pair of outer ends, a second pair of spaced arms having a pair of inner ends and a pair of outer ends, the inner ends of said second pair of arms being connected respectively to the outer ends of said first pair of arms, said second pair of arms extending convergently towards each other in said horizontal plane and in a direction away from said loop, the outer ends of said second pair of arms being closely adjacent each other, said clip including a third pair of arms extending from one pair of ends thereof to a second pair of ends thereof, said third pair of arms having their one pair of ends connected respectively to the outer ends of said second pair of arms and extending therefrom in substantially parallel relation with each other at right angles to said horizontal plane and on the same side thereof, said clip also including a fourth pair of arms having a pair of inner ends and a pair of outer ends constituting the ends of said piece of spring wire, said fourth pair of arms having their inner ends connected respectively to the second pair of ends of said third pair of arms and extending divergently away from each other and from said third pair of arms in a direction towards said loop, said fourth pair of arms being substantially parallel to said second pair of arms and being adapted to engage the outer surface of said first collar at positions spaced from said slots thereof, whereby, when a force is exerted against said third arms in a direction towards said first collar, a relative wedging action will occur between said first collar and said fourth pair of arms and whereby, as said clip moves in the direction of said force, said first pair of arms will be forced outwardly relative to each other so as to be urged out of said first groove.

* * * * *